US005572750A

United States Patent [19]

Johnston

[11] Patent Number: 5,572,750

[45] Date of Patent: Nov. 12, 1996

[54] TABLE AND CHAIR POOL

[76] Inventor: Thomas M. Johnston, 20 Linden Ct., Jersey City, N.J. 07305

[21] Appl. No.: 417,261

[22] Filed: Apr. 5, 1995

[51] Int. Cl.[6] ..... E04H 4/00

[52] U.S. Cl. ..... 4/494; 4/496; 4/513

[58] Field of Search ..... 4/494, 496, 506, 4/513

[56] References Cited

U.S. PATENT DOCUMENTS 3,813,702 6/1974 Diemond et al. ..... 4/494

FOREIGN PATENT DOCUMENTS 0028953 5/1981 European Pat. Off. ..... 4/513

1251094 10/1971 United Kingdom ..... 4/506

*Primary Examiner*—Charles E. Phillips

[57] ABSTRACT

A pool for supporting a table and chairs within a volume of water. The inventive device includes a bottom panel having a perimeter sidewall projecting upwardly therefrom. A central sidewall is concentrically positioned relative to the perimeter sidewall and projects from the bottom wall and about a central aperture directed therethrough. An anchor is positioned within the central wall for receiving an umbrella post to permit central positioning of a table and radially spaced positioning of chairs within the pool.

1 Claim, 3 Drawing Sheets

TABLE AND CHAIR POOL

BACKGROUND OF THE INVENTION

1. Field of the Invention

The present invention relates to pool structures and more particularly pertains to an table and chair pool for supporting a table and chairs within a volume of water.

2. Description of the Prior Art

The use of pool structures is known in the prior art. More specifically, pool structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art pool structures include U.S. Pat. Nos. 4,738,486; 4,893,363; 5,172,433; and 5,307,527.

While these devices fulfill their respective, particular objectives and requirements, the aforementioned patents do not disclose a table and chair pool for supporting a table and chairs within a volume of water which includes a bottom panel having a perimeter side wall projecting upwardly therefrom, a central side wall concentrically positioned relative to the perimeter side wall and projecting from the bottom wall about a central aperture directed therethrough, and an anchor positioned within the central wall for receiving an umbrella post to permit central positioning of a table and radially spaced positioning of chairs within the pool.

In these respects, the table and chair pool according to the present invention substantially departs from the conventional concepts and designs of the prior art, and in so doing provides an apparatus primarily developed for the purpose of supporting a table and chairs within a volume of water.

SUMMARY OF THE INVENTION

In view of the foregoing disadvantages inherent in the known types of pool structures now present in the prior art, the present invention provides a new table and chair pool construction wherein the same can be utilized for supporting a table and chairs within a volume of water. As such, the general purpose of the present invention, which will be described subsequently in greater detail, is to provide a new table and chair pool apparatus and method which has many of the advantages of the pool structures mentioned heretofore and many novel features that result in a table and chair pool which is not anticipated, rendered obvious, suggested, or even implied by any of the prior art pool structures, either alone or in any combination thereof.

To attain this, the present invention generally comprises a pool for supporting a table and chairs within a volume of water. The inventive device includes a bottom panel having a perimeter sidewall projecting upwardly therefrom. A central sidewall is concentrically positioned relative to the perimeter sidewall and projects from the bottom wall and about a central aperture directed therethrough. An anchor is positioned within the central wall for receiving an umbrella post to permit central positioning of a table and radially spaced positioning of chairs within the pool.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new table and chair pool apparatus and method which has many of the advantages of the pool structures mentioned heretofore and many novel features that result in a table and chair pool which is not anticipated, rendered obvious, suggested, or even implied by any of the prior art pool structures, either alone or in any combination thereof.

It is another object of the present invention to provide a new table and chair pool which may be easily and efficiently manufactured and marketed.

It is a further object of the present invention to provide a new table and chair pool which is of a durable and reliable construction.

An even further object of the present invention is to provide a new table and chair pool which is susceptible of a low cost of manufacture with regard to both materials and labor, and which accordingly is then susceptible of low prices of sale to the consuming public, thereby making such table and chair pools economically available to the buying public.

Still yet another object of the present invention is to provide a new table and chair pool which provides in the apparatuses and methods of the prior art some of the advantages thereof, while simultaneously overcoming some of the disadvantages normally associated therewith.

Still another object of the present invention is to provide a new table and chair pool for supporting a table and chairs within a volume of water.

Yet another object of the present invention is to provide a new table and chair pool which includes a bottom panel having a perimeter side wall projecting upwardly therefrom, a central side wall concentrically positioned relative to the perimeter side wall and projecting from the bottom wall about a central aperture directed therethrough, and an anchor positioned within the central wall for receiving an umbrella post to permit central positioning of a table and radially spaced positioning of chairs within the pool.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
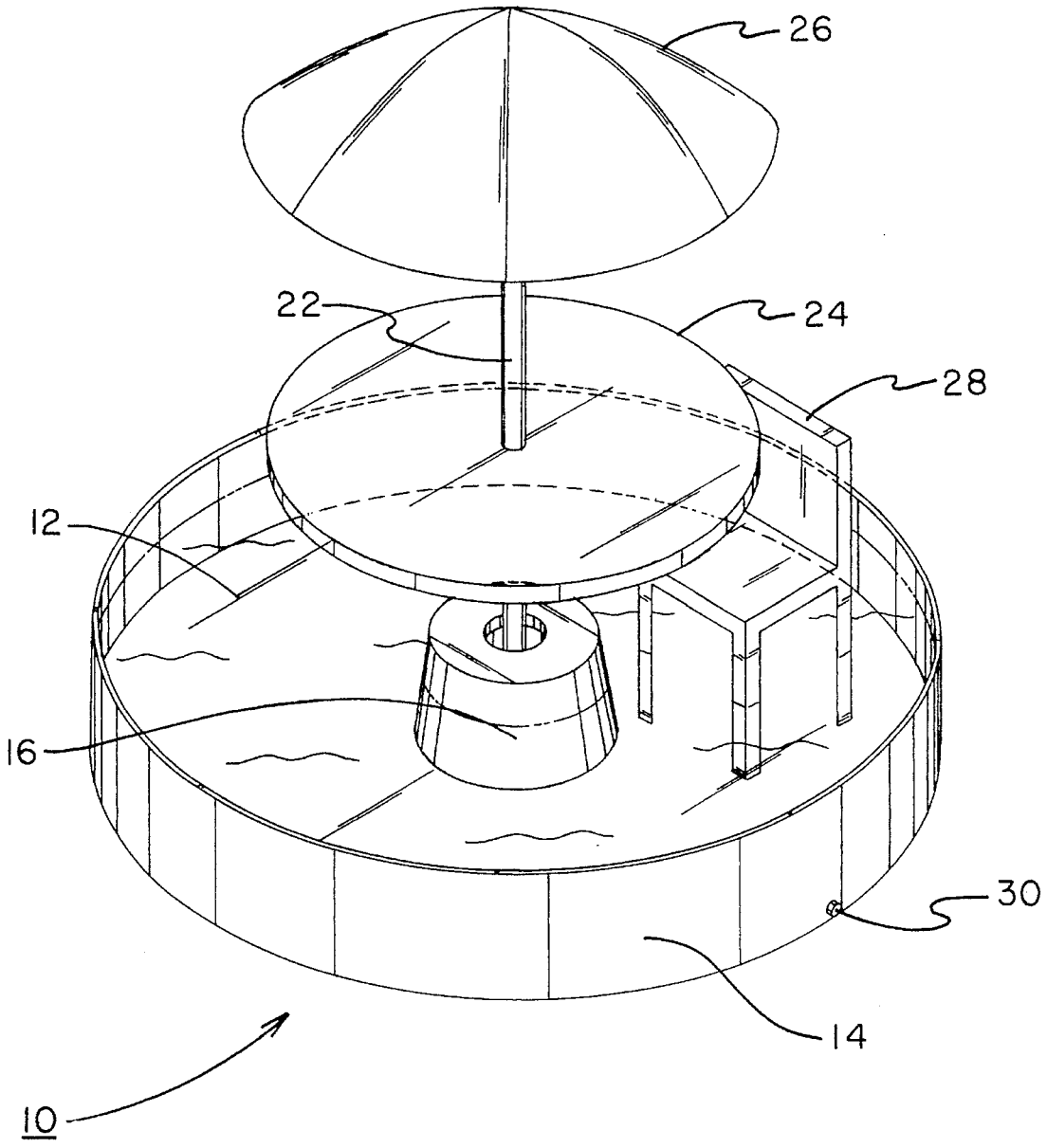
FIG. 1 is an isometric illustration of a table and chair pool according to the present invention in use.

With reference now to the drawings, and in particular to FIGS. 1–5 thereof, a new table and chair pool embodying the principles and concepts of the present invention and generally designated by the reference numeral 10 will be described.

More specifically, it will be noted that the table and chair pool 10 comprises a bottom panel 12 preferably being substantially circular in shape and having an unlabeled central aperture directed therethrough. A perimeter side wall 14 extends continuously about an outer periphery of the bottom panel 12 and is coupled thereto so as to project substantially orthogonally and upwardly therefrom. A central side wall 16 is concentrically positioned relative to the perimeter side wall 14 and is coupled to the bottom panel 12 so as to circumscribe the central aperture directed therethrough. The central side wall 16 projects upwardly from the bottom panel 12 and cooperates with the perimeter side wall 14 so as to permit the retention of a volume of water, as shown in FIG. 1, within the pool 10.

Figure 2:
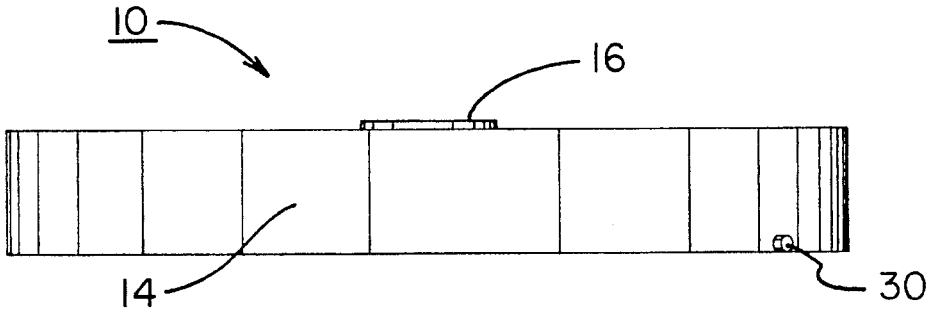
FIG. 2 is a side elevation view thereof.
Figure 3:
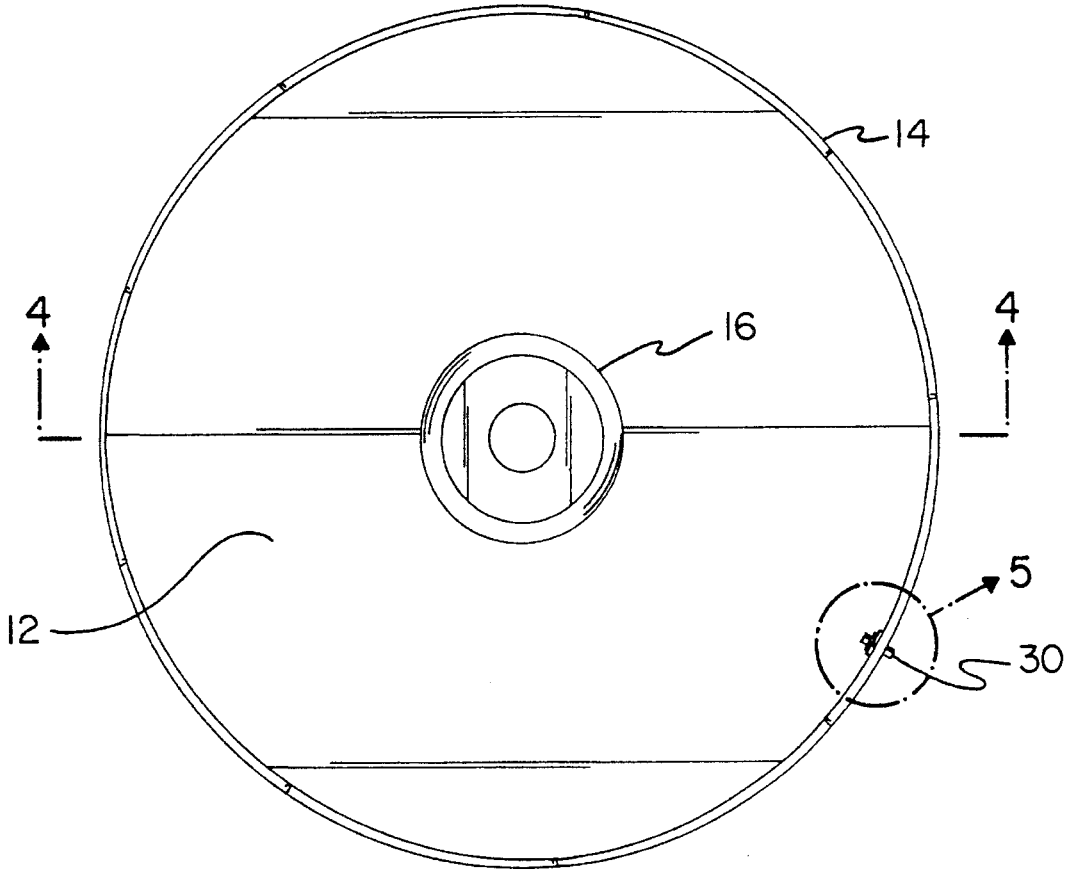
FIG. 3 is a top plan of the invention.
Figure 4:
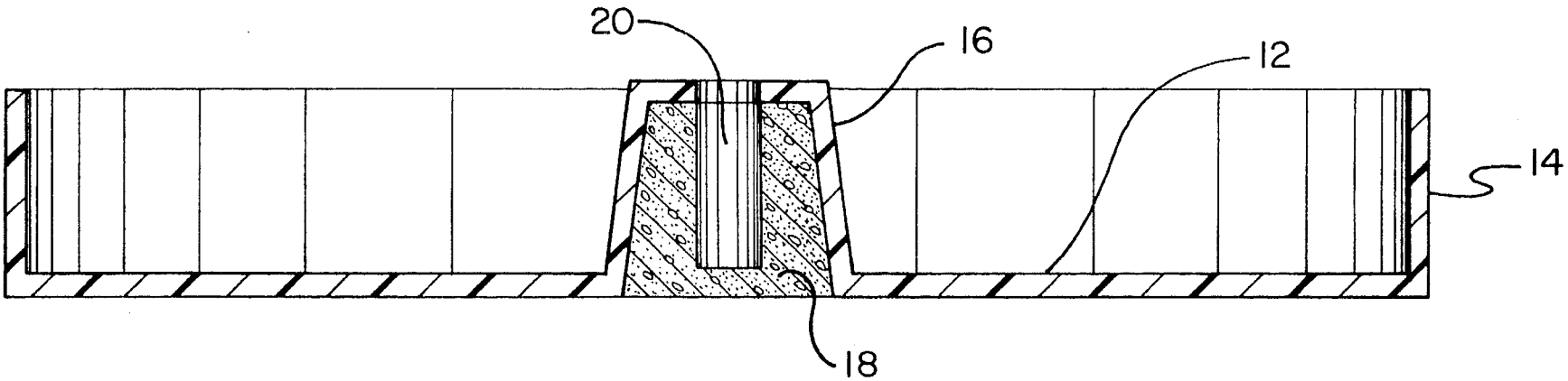
FIG. 4 is a cross sectional view taken along line 4—4 of FIG. 3.
Figure 5:
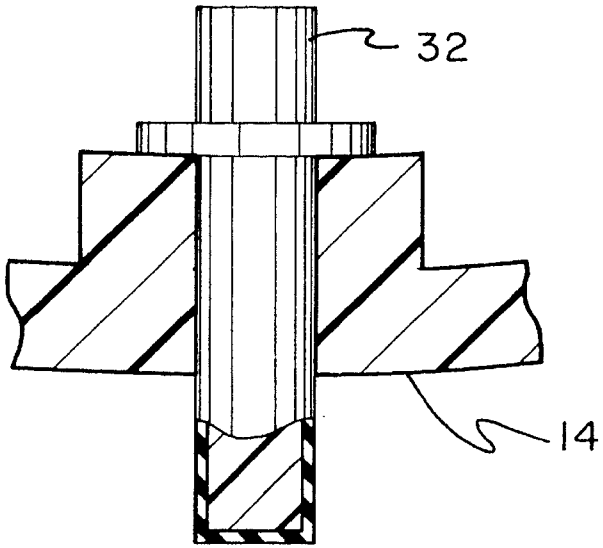
FIG. 5 is an enlarged cross sectional view of the area set forth in FIG. 3.

As shown in FIGS. 2 through 4, the present invention 10 further comprises an anchor 18 positioned through the central aperture in the bottom panel 12 and within the central side wall 16. The anchor 18 may be constructed of any desired material but is preferably comprised of concrete or a similarly dense material and includes a receiving bore 20 directed thereinto permitting the insertion of a center stanchion 22 into the anchor 18 so as to support the center stanchion 22 in the vertical orientation shown in FIG. 1. A table 24 can be supported by the center stanchion 22 so as to be concentrically positioned within the pool 10 relative to the perimeter side wall 14. Alternatively, the table 24 may include a plurality of depending legs which engage an upper surface of the bottom panel 12 so as to support the table 24 absent the center stanchion 22. An umbrella 26 can be secured to an upper distal end of the center stanchion 22 so as to reside over the table 24 as shown in FIG. 1. By this structure, a plurality of chairs 28 can be positioned between the central side wall 16 and the perimeter side wall 14 about the table 24, whereby individuals residing within the chair 28 will benefit from the water positioned within the pool 10.

As shown in FIGS. 1 through 3, and 5, it can be shown that the present invention 10 may further comprise a drain valve 30 directed through the perimeter side wall 14 for permitting selective draining of fluids or water from the pool 10 as desired by an end user subsequent to use of the device 10. To this end, an unlabeled drain aperture is directed through the perimeter side wall 14, with a plug 32 extending through the drain aperture from an interior of the perimeter side wall 14. By this structure, a pressure of water residing within the pool 10 will bias the plug 32 into the drain aperture of the perimeter side wall 14 so as to preclude unintentional removal thereof. Thus, to drain the pool 10, an individual may simply reach into the pool grasped the plug 32, whereby a pulling of the plug 32 from the drain aperture will permit drainage of such water from the pool.

In use, the table and chair pool 10 according to the present invention can be easily utilized to support a table and a plurality of chairs within a volume of water. The present invention may also be used in combination with the center stanchion 22 supporting the umbrella 26 as desired.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A table and chair pool comprising:

a bottom panel formed in a generally circular configuration and having a central aperture directed therethrough;

a perimeter side wall extending continuously about an outer periphery of the bottom panel and being coupled to the thereto so as to project substantially orthogonally and upwardly therefrom , the perimeter side wall being shaped so as to define a drain aperture directed therethrough;

a central side wall concentrically positioned relative to the perimeter side wall and being coupled to the bottom panel so as to extend about the central aperture directed therethrough;

a center stanchion having an upper end and a lower end, an anchor fabricated of concrete and positioned through the central aperture in the bottom panel and within the central side wall, the anchor including a receiving bore directed thereinto permitting the insertion of the lower end of the center stanchion into the anchor to support the center stanchion in a vertical orientation;

a table supported by said center stanchion between said upper and lower ends;

a plurality of chairs positioned between the central side wall and the perimeter and about the table;

a drain valve directed through the perimeter side wall for permitting selective draining of fluids from the pool, the drain valve comprising a plug extending through the drain aperture from an interior of the perimeter of the side wall; and an umbrella being secured to the upper end of the center stanchion.

* * * * *